US005813535A

United States Patent [19]

Tseng

[11] Patent Number: 5,813,535

[45] Date of Patent: Sep. 29, 1998

[54] HOUSING DEVICE FOR CHRISTMAS LIGHT BULBS

[76] Inventor: Jeou-Nan Tseng, No. 539, Sec. 4, Chunghua Rd., Hsinchu, Taiwan

[21] Appl. No.: 931,354

[22] Filed: Sep. 16, 1997

[51] Int. Cl.[6] ..... B65D 85/42

[52] U.S. Cl. ..... 206/419; 206/702

[58] Field of Search ..... 206/418–422, 206/702; 211/26, 26.2; 362/249

[56] References Cited

U.S. PATENT DOCUMENTS

| | | | |
|---|---|---|---|
| 2,984,347 | 5/1961 | Kalinchuk | 206/419 |
| 5,103,977 | 4/1992 | Douglas | 206/702 |
| 5,123,534 | 6/1992 | Chwang | 206/419 |
| 5,168,999 | 12/1992 | Lee et al. | 206/420 |
| 5,222,602 | 6/1993 | Liao | 206/420 |
| 5,317,491 | 5/1994 | Lee | 206/420 |
| 5,458,241 | 10/1995 | Brown | 206/419 |

*Primary Examiner*—Jimmy G. Foster
*Attorney, Agent, or Firm*—Parkhurst & Wendel, L.L.P.

[57] ABSTRACT

A housing device for Christmas light bulbs is able to securely receive not only the light bulbs therein, but also the plug. Furthermore, a resilient plate integrally formed on the housing device is able to provide necessary resilience to bring the plug back to its original position within the housing device after the plug is pulled out from the housing device.

6 Claims, 5 Drawing Sheets

HOUSING DEVICE FOR CHRISTMAS LIGHT BULBS

FIELD OF THE INVENTION

The present invention generally relates to a housing device, and more particularly to a housing device for a set of Christmas light bulbs, which provides on two opposed sides thereof a plurality of seats for receiving light bulbs of decorations therein and on an end portion thereof a retaining device for retaining a plug of the Christmas light bulbs therein.

BACKGROUND OF THE INVENTION

Using light bulbs as a decoration to a Christmas tree is very popular throughout the world. Due to the popularity of these "Christmas light bulbs", manufacturers will need a housing device to enclose the light bulbs therein. A conventional housing device 40 is shown in FIG. 9. The housing device 40 has a body (not numbered) configured to provide cushioning to the light bulbs received therein, a plurality of seats 42 formed integrally on both sides thereof, and a receiver 44 formed to receive a plug (not shown or labeled) of the light bulbs. However, because the receiver 44 is integrally fixed onto a face of the housing, the size of the receiver 44 is fixed. When a decoration having a plurality of light bulbs 43, a wire 45 electrically connected with the light bulbs 43 and a plug (not shown) is about to be received within the housing device 40, all the light bulbs 43 will be sequentially clamped by each of the seats 42 and the plug will be securely received within the receiver 44. When the plug is designed to have different size, it is not able to be fitted into and received by the receiver, such that manufacturers will have to produce different kinds of housing device to enclose the decoration, which increases cost and inventory. Furthermore, when the decoration is displayed in retail shops, customers generally will ask for a test on the product to make sure every light bulb within the housing device 40 functions normally. In this situation, the shop owner will have to remove the housing device 40 from a wrapping material (not shown) to proceed with the test, which is time-consuming and not necessary.

From the previous description, it is noted that to fully solve the aforementioned problems, alternatives and/or improvement(s) to the conventional housing device are thus required. A housing device constructed in accordance with the present invention tends to mitigate and/or obviate the aforementioned problems.

SUMMARY OF THE INVENTION

In accordance with one aspect of the invention, a housing device for a Christmas light bulb includes a plurality of seats mounted on both sides thereof for receiving the light bulbs therein, and a resilient plate having mounted thereon two pairs of brackets for receiving two conducting pins of a plug therein.

The main objective of the invention is to provide a housing device for a Christmas light bulb, such that different decorations with different sized plugs are still able to be received within the housing device.

Another objective of the invention is to provide a resilient plate having a groove defined therein, such that the user will not have to remove the whole set of the decoration from a wrapping material to proceed with a test to see if each of the light bulbs of the decoration functions normally. The user is able to simply pull out the resilient plate from an opening defined in the wrapping material, and due to the plug being securely mounted onto the resilient plate, the user may then proceed with the test after removing the plug from the resilient plate. When the test is finished, and after the user puts the plug back on the resilient plate, the resilient plate will automatically return to its original position because of the resilience, which saves a lot of trouble for the test person.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
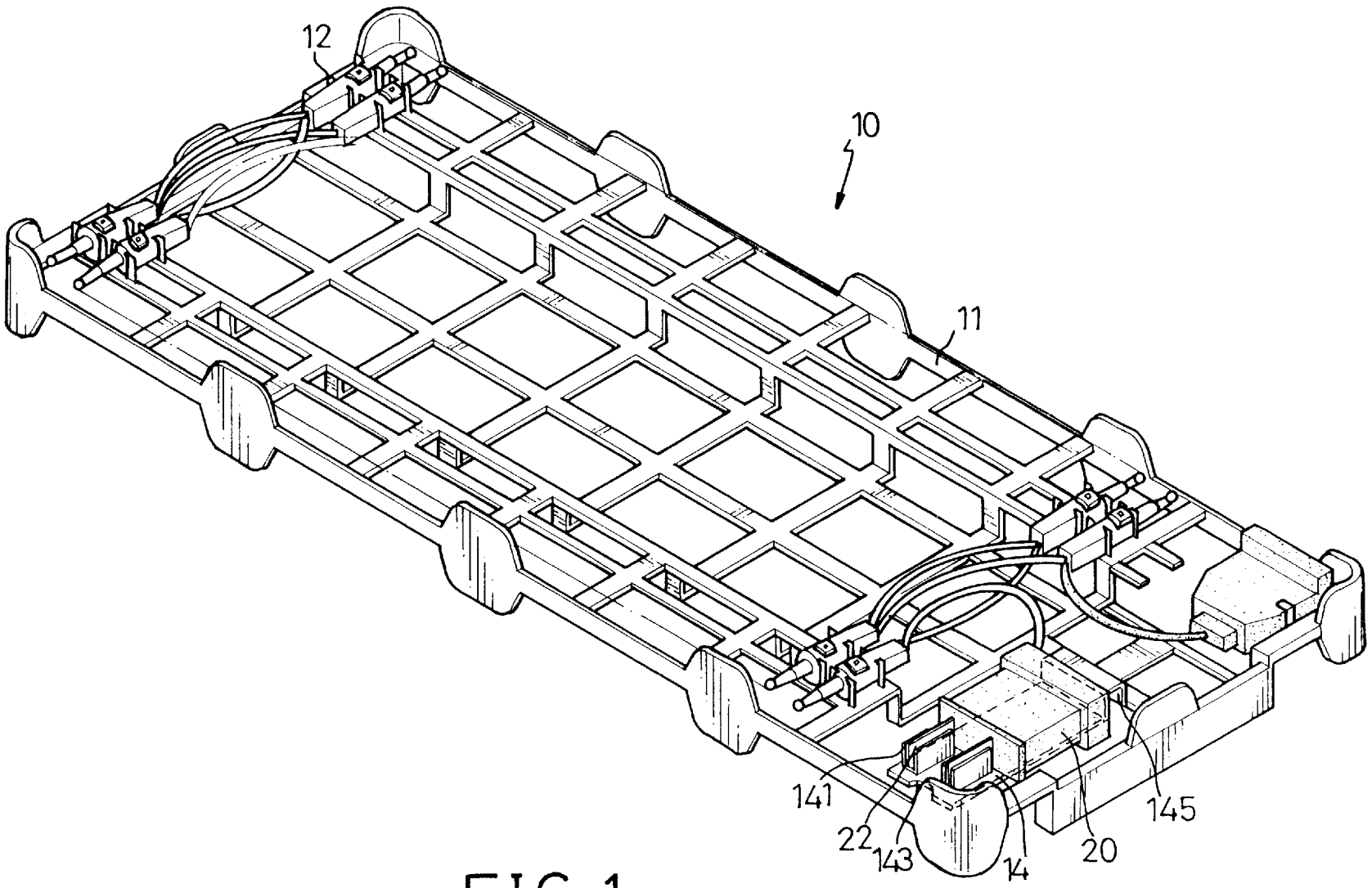
FIG. 1 is a perspective view of a housing device for a set of Christmas light bulbs constructed in accordance with the present invention.
Figure 3:
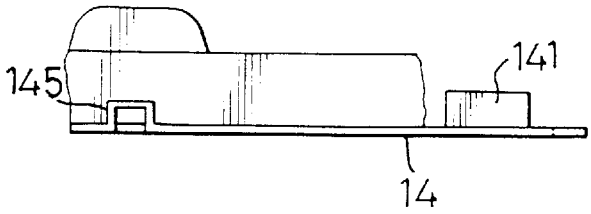
FIG. 3 is a partial schematic plane view of the invention.
Figure 4:
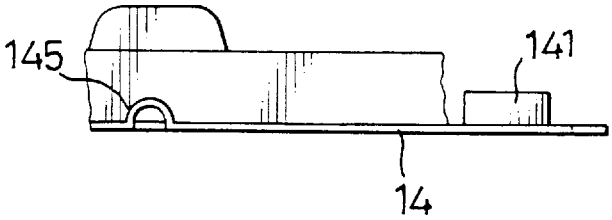
FIG. 4 is a partial plane view of another embodiment of the resilient plate.
Figure 2:
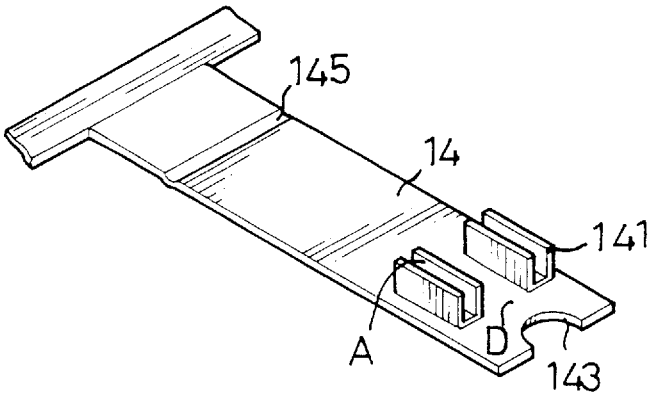
FIG. 2 is a perspective view showing another type of a resilient plate of the invention.

Referring to FIG. 1, one preferred embodiment of a housing device 10 constructed in accordance with the present invention and is shown. The embodiment intends in descriptive purpose and not in any form to limit the scope of the present invention, such that the features of the present invention also apply to various forms of housing devices.

In the preferred embodiment of FIG. 1, the housing device 10 of the invention includes a body 11, a plurality of seats 12 integrally formed on opposed sides of the body 11 and a resilient plate 14 integrally formed on the body 11 and adjacent to one side of the seats 12.

Figure 5:
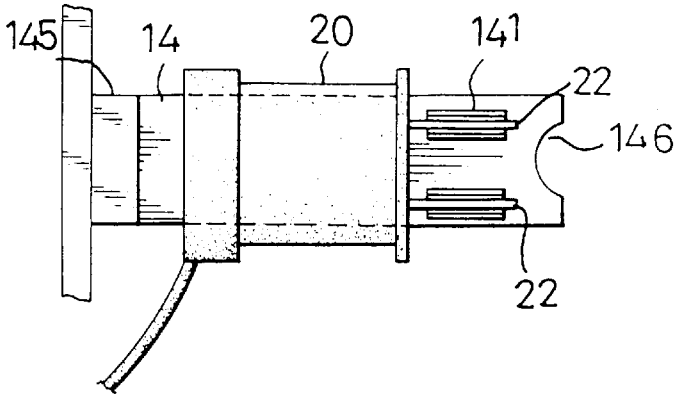
FIG. 5 is a partial top plane view showing that a plug is securely received on a resilient plate of the invention.

Referring to FIGS. 1, 2, 3 and 4, the resilient plate 14 has formed thereon a pair of brackets 141 each spaced apart for a distance D and having a volume A defined therein for receiving a respective one of a pair of conducting pins 22 of a plug 20 therein, a cutout 143 defined in an end face thereof and a groove 145 defined in a predetermined portion thereof. The groove 145 may be configured to have a rectangular shape or an arcuate shape, such that it is able to provide a pre-determined deformation point. Due to the resilience of the material of the brackets 141, the distance D between the two brackets 141 is variable so that the pair of conducting pins 22 of the plug 20 is able to be received within the volume A of each of the bracket 141, and therefore, the plug 20 is securely received onto the resilient plate 14 (as shown in FIG. 5).

Figure 6:
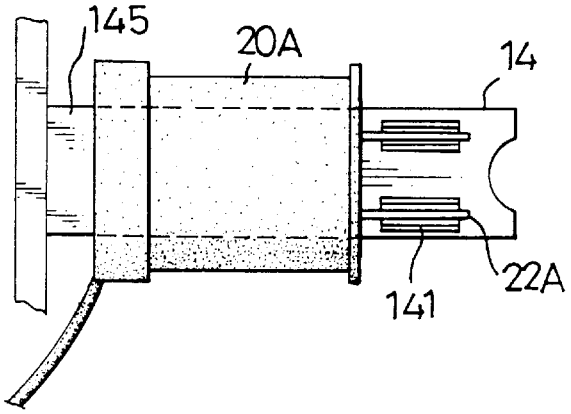
FIG. 6 is a partial top plane view showing that a different plug is securely received on the resilient plate of the invention.
Figure 7:
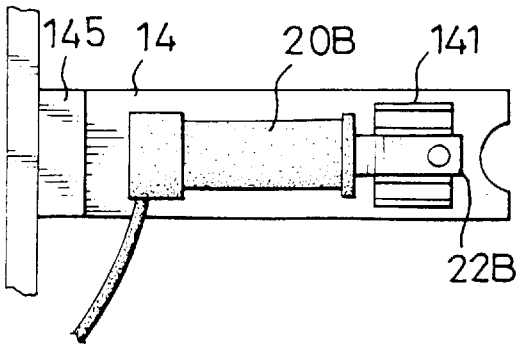
FIG. 7 is a partial top plane view of the invention showing that the plug is received on the resilient plate in a way different from that used in FIGS. 3 and 4.

When a different plug 20A having conducting pins 22A different to the conducting pins 22 is to be received onto the resilient plate 14 and between the pair of brackets 141, the brackets 141 are still able to retain the plug 20A (as shown in FIG. 6). However, if a size of a pair of conducting pins 22B of a plug 20B is too big to be fitted between the volumn A, the plug 22B is still able to be received between the distance D after the plug 20B is rotated 90, as shown in FIG. 7.

Figure 8:
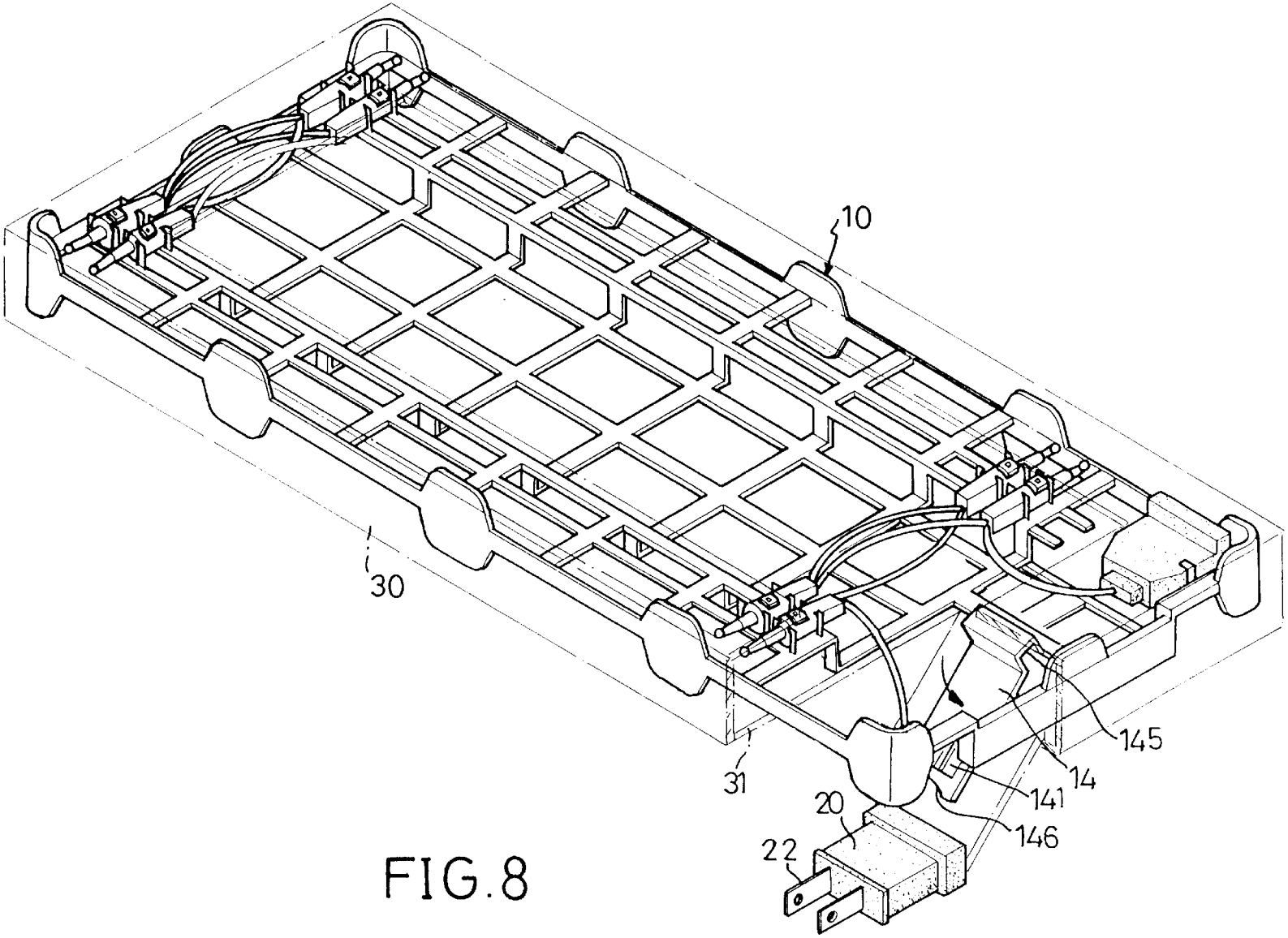
FIG. 8 is a perspective view of an embodiment of the invention.
Figure 9:
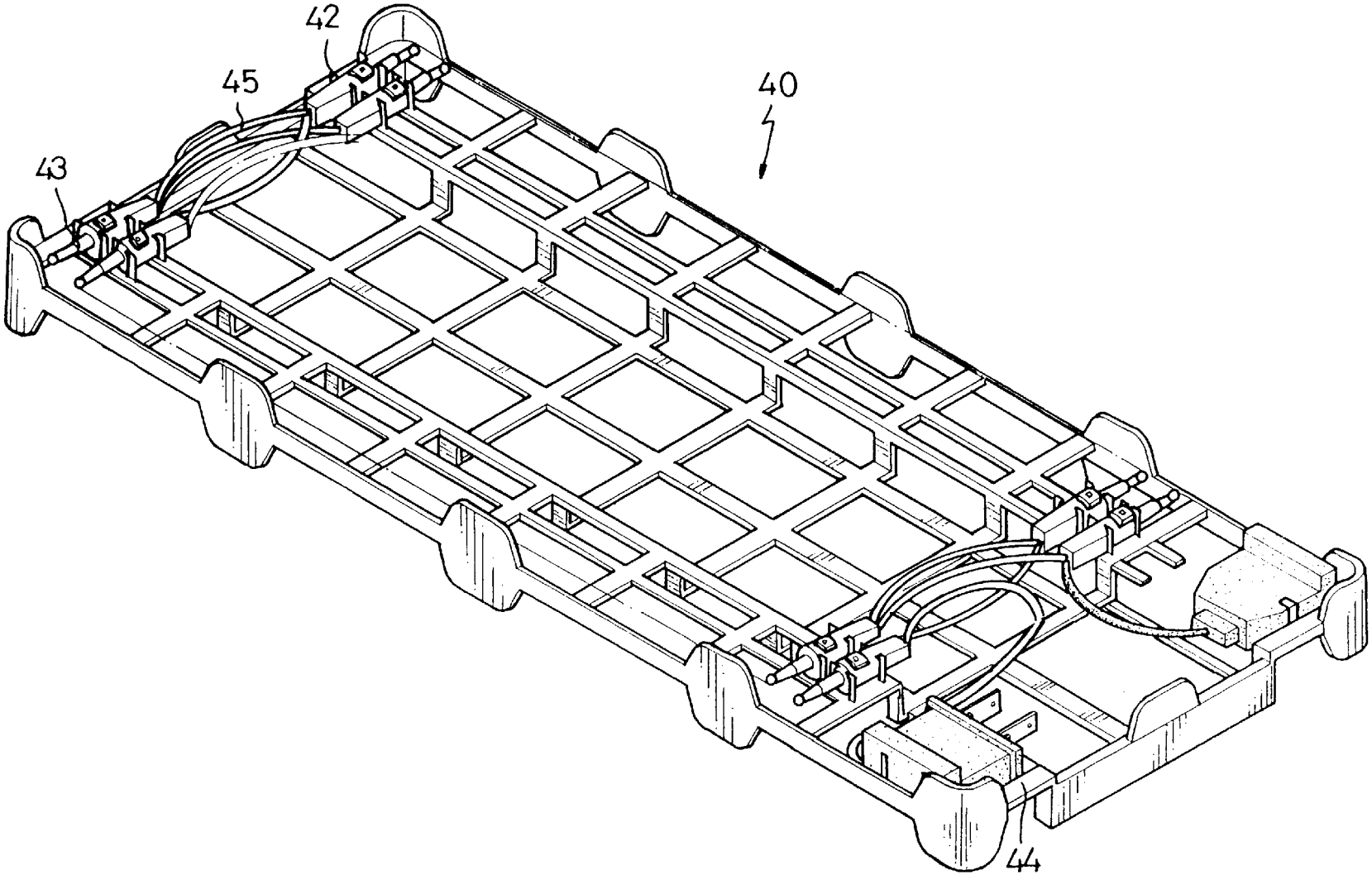
FIG. 9 is a perspective view of a conventional housing device for a set of Christmas light bulbs.

Referring to FIG. 8, when the housing device 10 of the invention is wrapped with by a wrapping material 30, in order to proceed with a test checking to see if every light bulbs works normally, a user will only need to open an access portion 31 defined in the wrapping material 30 and then pull out the resilient plate 14 together with the plug 20 via the cutout 146. When the test is finished, the user will only need to replace the plug 20 within the brackets 141, the resilient plate 14 will then automatically return to its original position and then close the access portion 31 of the wrapping material 30.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A housing device for Christmas light bulbs comprising a body having a plurality of seats integrally formed on opposed sides of the body for securely receiving the light bulbs therein, the improvements are:

a resilient plate is integrally formed onto the body and adjacent to one side of the seats and has a pair of spaced brackets integrally formed thereon and a groove defined therein.

2. The housing device as claimed in claim 1, wherein a cutout is defined in an end face of said resilient plate.

3. The housing device as claimed in claim 1, wherein said groove has a rectangular shape.

4. The housing device as claimed in claim 1, wherein said groove has an arcuate shape.

5. The housing device as claimed in claim 1, wherein a volume defined within each of said pair of brackets is able to receive the conducting pins of the plug.

6. The housing device as claimed in claim 5, wherein a distance defined between said pair of brackets is able to securely receive the conducting pins of the plug when rotated 90°.

* * * * *